United States Patent [19]

Kano

[11] Patent Number: 4,814,956

[45] Date of Patent: Mar. 21, 1989

[54] LAMP

[75] Inventor: Tetsuhiro Kano, Leichlingen, Fed. Rep. of Germany

[73] Assignee: Heinz Bahren, Fed. Rep. of Germany

[21] Appl. No.: 859,130

[22] Filed: May 2, 1986

[51] Int. Cl.[4] ..... F21V 9/00

[52] U.S. Cl. ..... 362/293; 362/2; 362/166; 362/311; 350/320; 272/10

[58] Field of Search ..... 362/166, 293, 307, 311, 362/2, 3, 16–18; 350/311, 320, 316, 317, 166; 272/10

[56] References Cited

U.S. PATENT DOCUMENTS 1,768,812 7/1930 Whiting ..... 350/311
4,602,321 7/1986 Bornhorst ..... 362/293

OTHER PUBLICATIONS

*Illuminating Engineering,* F. E. Cody and H. B. Dates (editors), John Wiley & Sons, Inc., N.Y., pp. 321, 322, 1925.

*The Scientific Basis of Illuminating Engineering,* Parry Moon, McGraw-Hill Book Co., Inc., N.Y., 1936, pp. 475, 484, 485.

*Primary Examiner*—Samuel Scott
*Assistant Examiner*—Noah Kamen
*Attorney, Agent, or Firm*—Limbach, Limbach & Sutton

[57] ABSTRACT

A lamp is provided having a light source and a suppression mechanism, for example an absorbing mirror reflector and/or an absorbing or reflecting filter, for partially suppressing color components of the light coming from the light source for the purpose of enhancing surface colors of an object to be illuminated, said surface colors being different from the suppressed color components.

12 Claims, 2 Drawing Sheets

LAMP

DESCRIPTION

1. Technical Field

This invention involves a lamp with a light source and a suppression mechanism, for example an absorbing mirror reflector and/or an absorbing or reflecting filter, for partially suppressing color components of the light coming from the light source for the purpose of enhancing surface colors of an object to be illuminated, said surface colors being different from the suppressed color components.

2. Background of the Invention

Products are often illuminated with appropriate lighting to improve the presentation of such products. In so doing, care is taken to enhance the primary surface color by means of the illumination. This is achieved in the state of the art by equipping the lamps with different color filters or by appropriately coloring the bulb of the incandescent lamp such that the light emitted by the lamp contains only color components corresponding to the surface color to be enhanced. All other color components are absorbed or suppressed by reflection using a filter.

Usually, however, a product exhibits a number of surface colors. In addition, the background must be taken into consideration. In the technique for enhancing a specific surface color just described, the other surface colors, those not contained in the filtered light, are reproduced with distortion. Also, white areas, for example in the background, acquire a coloring corresponding to the unsuppressed hue. Using this technique to enhance a specific surface color thus has the disadvantage that other colors are subjected to a great degree of distortion so that the total impression of color is unnatural.

Another disadvantage is that suppressing all color components with the exception of that component corresponding to the surface color creates high power losses. A specific brightness can thus only be achieved by correspondingly increased power consumption.

The object of this invention is thus to design a lamp which, in spite of enhancing a specific surface color, achieves natural lighting of the product to be illuminated. It is a further object of this invention that the power consumption of such a lamp be reduced.

The object is achieved by this invention in that the suppression mechanism essentially suppresses only the color components having a color spectrum locus on the chromaticity diagram lying opposite the color spectrum locus—passing roughly through the achromatic point—of the surface color to be enhanced.

DETAILED DESCRIPTION OF THE INVENTION

Figure 1:
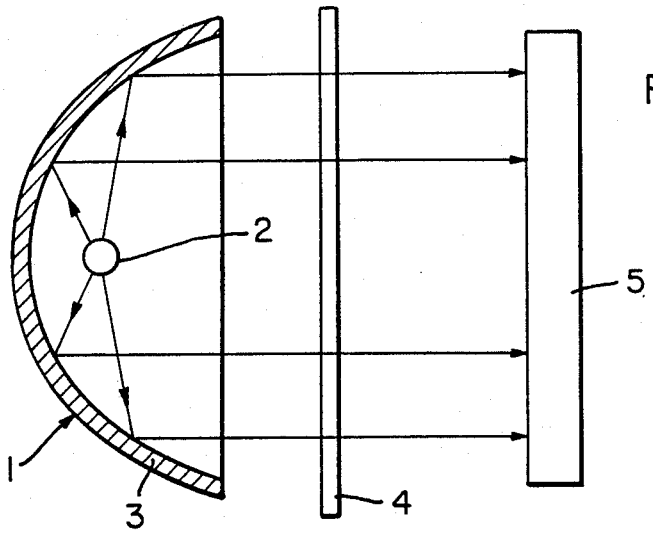
FIG. 1 shows the schematic representation of a lamp.

The present invention is based on the following considerations. In general, under normal illumination, the coloring matter which makes up the surface color of an object reflects not only the color components corresponding to the surface color but also all other color components, if only to a relatively low percentage. These other color components are not completely absorbed, as a rule. As a result, the color spectrum locus in the chromaticity diagram lies not in the edge area, thus in the area of maximum saturation, but rather is shifted inward in the direction of the achromatic point. With the lamp of this invention, the color components which cause such a shift in the color spectrum locus under normal illumination are filtered out such that the degree of saturation of the surface color is increased, thus the color spectrum locus migrates in the direction of the edge of the chromaticity diagram. The surface color therefore appears enhanced in comparison to illumination under normal light. The special advantage of this is that the other colors of the object to be illuminated are distorted either only to a slight degree or not at all as the color components of these colors are still contained in the radiated light. An additional important side effect is that this suppression only causes small energy losses corresponding to a small portion of the color spectrum.

The design of this invention provides that the suppression mechanism to enhance warm colors (orange, red) as the surface colors suppresses color components having wavelengths ranging from 480 nm to 570 nm. To enhance cold colors (blue, green) as the surface colors, the suppression mechanism is to suppress color components having wavelengths from 580 nm to 620 nm. Of course, other wavelength ranges can be used as the color components to be suppressed in the event of intermediate colors.

In order to avoid a noticeable difference between the light emitted by the lamp of this invention and normal light against a white background, the color components suppressed by the invention are not to be completely removed from the light. For practical purposes, the absorption or reflection of these color components should be at least 30% but at most 70%. In addition, the transition to the range of color components to be chiefly suppressed from the color components in the maximum suppression range should occur gradually, thus not in discrete steps.

The invention is described in more detail in the drawings using a preferred embodiment of the present invention.

The lamp 1 shown schematically in FIG. 1 has a light source 2, a mirror reflector 3 and a filter 4 at the outlet of the mirror reflector 3. An object 5 which has a specific surface color and which is to be illuminated is located at a distance from the filter 4.

The light source may be an incandescent bulb, a fluorescent lamp or a high-pressure gas-discharge lamp with better color reproduction than stage 3 of DIN 5035, or a xenon lamp. The filter 4 can be manufactured in that an appropriate thin layer is applied to clear glass or clear plastic by means of vapor deposition or painting, or that the glass or plastic is appropriately colored. It presents no difficulty for one skilled in the art to provide the coating or coloring such that only specific color components are absorbed or reflected while the other color components are transmitted.

The surface of the mirror reflector 3 can be made of aluminum or silver or it can be designed as a diathermic mirror coating. The latter has a selective effect, i.e. it reflects only the light rays in the visible spectrum while transmitting the thermal radiation in the infrared region.

As an alternative to the preferred embodiment described with reference to FIG. 1, the lamp can also be designed such that the color components are suppressed not by means of absorption or reflection, using an additionally mounted filter, but rather by means of a special design of the mirror reflector. Namely, selective absorption of the color components on the mirror reflector can be achieved by appropriate painting or by using an anodizing process. This selective absorption can be designed so that a specific range of wavelengths is absorbed whereas all other color components are reflected by the mirror reflector. This can be achieved using conventional materials and manufacturing methods. A combination of both measures, thus a combination of a filter and selectively reflecting mirror reflector, is also conceivable and intended to be within the scope of the appended claims.

Figure 2:
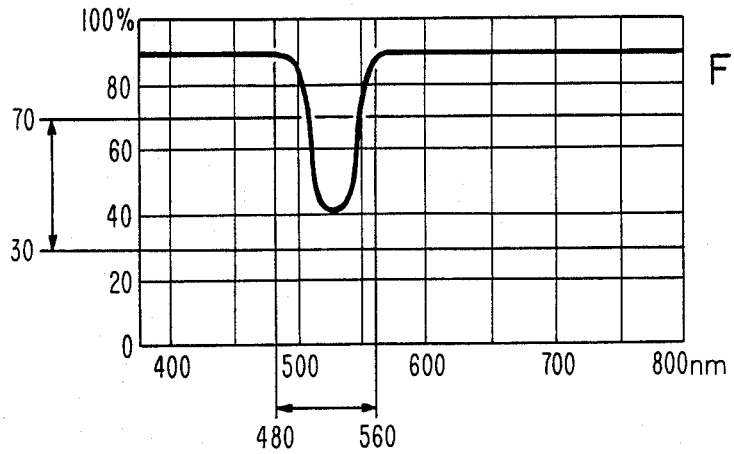
FIG. 2 is a graph showing the transmission of the lamp of FIG. 1, designed for warm colors.
Figure 3:
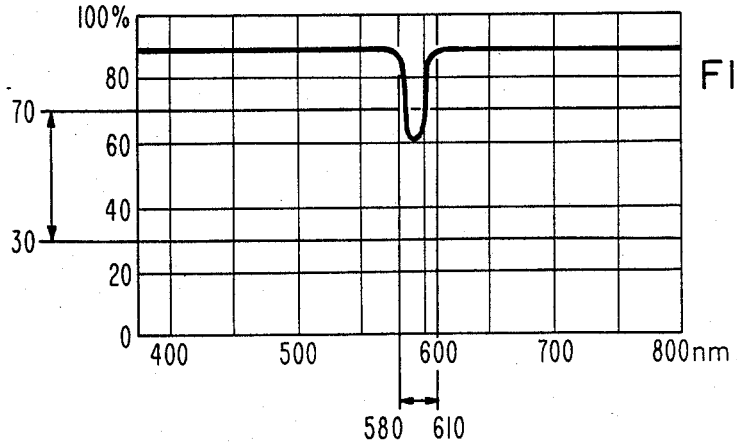
FIG. 3 is a graph showing the transmission of the lamp of FIG. 1, designed for cold colors.

FIGS. 2 and 3 depict the transmission properties of the light 1 shown in FIG. 1 with two different filters. In these figures, the transmission is listed along the abscissa as the reciprocal of absorption or reflection in per cent while the wavelengths of the color components, starting with lilac (380 nm), progressing to blue (450 nm), green (520 nm), yellow (580 nm), up to deep red (780 nm), are specified along the ordinate.

In the filter 4 having the transmission characteristics shown in FIG. 2, the residual absorption or residual reflection which can not be avoided is approx. 10% for all color components, i.e. the transmission is 90%. By using an appropriate coating or coloring, the transmission is reduced in a specific range, namely between 480 nm and 560 nm, to 40%, i.e. up to 60% of the color components between 480 nm and 560 nm are suppressed. As can clearly be seen in the illustration, the transitions from the range of high transmission and the transition in the range of minimum transmission are rounded so that the difference between light filtered in this manner and light which is not filtered is unnoticeable on a white object. A light 1 with such a filter 4 is designed for enhancing warm colors as the surface colors as, with the range of 480 nm to 560 nm, the cold hues of blue and green are partially filtered out resulting in a saturation and thus enhancement of the warm colors.

FIG. 3 shows the transmission characteristics of another filter 4. The coating or coloring of this filter is designed so that maximum absorption or reflection is achieved in the range between 580 nm and 610 nm, thus in the red spectrum. The maximum absorption or reflection in this case is 40% in relation to the absorption or reflection of the other color components which only has a value of 10%. The transitions are rounded here, also. A lamp 1 with such a filter 4 is suited to enhancing cold colors, in particular blue and green. These cold colors are provided with a higher saturation and thus are more pronounced due to the filtering of the red component.

Figure 4:
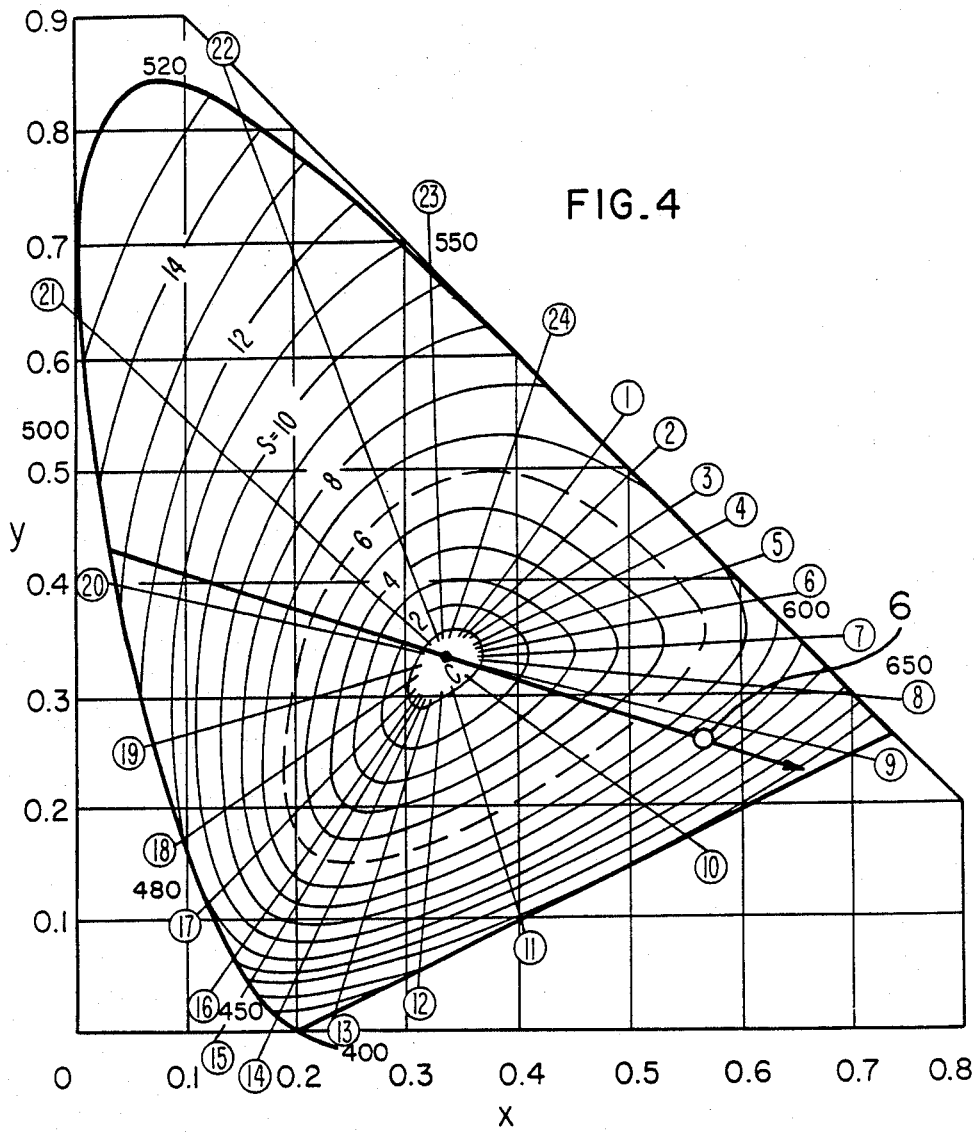
FIG. 4 shows the chromaticity diagram of German Industry Standard (DIN) 5033 in the black-and-white implementation.

FIG. 4 shows the chromaticity diagram of DIN 5033 in a black-and-white representation. The values x and y on the ordinate and abscissa, respectively, specify the trichromatic coefficients. These coordinates thus specify the color spectrum locus of a specific chromaticity. The point C, known as the achromatic point, lies in the central area. The edge curve is composed of the spectral colors and the so-called purple boundary. Several wavelengths are specified in nm along the spectral curve. All other chromaticities lie between the achromatic point (C) and the edge curve. Each of the lines radiating outward from the achromatic point C contains the colors of the same hue in increasing saturation and are marked with the numbers 1 to 24. The chromaticity of an additive color mixture using two components always lies in the chromaticity diagram on the straight line connecting the chromaticities of these components. The oval lines surrounding the achromatic point C mark color spectrum loci having equal saturation S.

The color spectrum locus 6 of one surface color, as an example, is marked in the lower right-hand corner of the chromaticity diagram. This locus lies in the red region, thus in the warm color region. Its saturation is incomplete—as is the case for all normally produced coloring matters. If, by using an appropriately designed filter 4, the color components having wavelengths of approximately 495 nm lying on the opposite side of the achromatic point C from the color spectrum locus 6 are filtered out, the degree of saturation is increased so that the color spectrum locus 6 migrates outward in the direction of the arrow toward the edge of the spectral color curve. The increase in the degree of saturation achieved in this manner causes the surface color to be enhanced accordingly without any other surface colors being distorted.

I claim:

1. A method for selectively enhancing the surface colors of an object to be illuminated which comprises:

(a) providing a lamp having a light source and a wavelength-dependent filter means for partially filtering color components from the light emanating from said light source for the purpose of enhancing surface colors of an object to be illuminated by said lamp;

(b) providing an object to be illuminated;

(c) illuminating that object with said lamp; and, (d) enhancing the surface colors of that object by essentially filtering only those color components in the light source-emanated light having a color spectrum locus on the chromaticity diagram lying opposite the color spectrum locus, passing substantially through the achromatic point of the object surface color to be enhanced.

2. The method according to claim 1 wherein the warm object surface colors are enhanced by partially filtering the color components in said source light having wavelengths ranging between 480 nm and 570 nm.

3. The method according to claim 1 wherein the cold object surface colors are enhanced by partially filtering the color components in said source light having wavelengths between 580 nm and 620 nm.

4. The method according to claim 1 wherein the object surface colors are enhanced by partially filtering at least 30% of the source-emanated light in the wavelength range to be essentially filtered.

5. The method according to claim 1 wherein the object surface colors are enhanced by partially filtering no more than 70% of the source-emanated light in the wavelength range to be essentially filtered.

6. An illumination system which comprises:

an object to be illuminated having surface colors; and, a lamp having a light source and a wavelength dependent filter means for partially filtering color components from the light emanating from said light source for the purpose of enhancing said surface colors of the object to be illuminated by said lamp, said object surface colors to be enhanced being different from said partially filtered color components whereby said wavelength-dependent filter means essentially filtering only those color components in the light-source emanated light having a color spectrum locus passing substantially through the achromatic point of the object surface color to be enhanced.

7. An illumination system according to claim 6 for enhancing warm object surface colors in the purple and red range wherein said wavelength-dependent filter means partially filters color components in said light source having wavelengths ranging between 480 nm and 570 nm.

8. An illumination system according to claim 6 for enhancing cold object surface colors in the blue and green range wherein said wavelength-dependent filter means partially filters color components in said light source having wavelengths between 580 nm and 620 nm.

9. An illumination system according to claims 6, 7 or 8 wherein said wavelength-dependent filter means partially filters at least 30% of the source-emanated light in the wavelength range to be essentially filtered.

10. An illumination system according to claims 6, 7 or 8 wherein said wavelength-dependent filter means partially filters no more than 70% of the source-emanated light in the wavelength range to be essentially filtered.

11. An illumination system according to claim 6 wherein said wavelength-dependent filter means comprises a selectively permeable filter.

12. An illumination system according to claim 6 wherein said wavelength-dependent filter means comprises a selectively reflecting mirror.

* * * * *